US007080850B2

(12) United States Patent
Ekberg

(10) Patent No.: US 7,080,850 B2
(45) Date of Patent: Jul. 25, 2006

(54) CONFIGURABLE SNOWSHOE AND SKI DEVICE

(76) Inventor: Lane Ekberg, 7135 Ponderosa Dr., Salt Lake City, UT (US) 84121

( * ) Notice: Subject to any disclaimer, the term of this patent is extended or adjusted under 35 U.S.C. 154(b) by 0 days.

(21) Appl. No.: 10/932,777

(22) Filed: Sep. 2, 2004

(65) Prior Publication Data

US 2005/0046149 A1 Mar. 3, 2005

(51) Int. Cl.
*A63C 5/02* (2006.01)

(52) U.S. Cl. ..... 280/603; 280/601; 280/20; 36/116; 36/123; 36/125

(58) Field of Classification Search ..... 280/603, 280/601, 604, 605, 607, 608, 609, 600, 809, 280/11.16, 14.21, 14.22, 14.26, 20, 28.14, 280/28.15, 28.16, 14.2, 28.1, 14.25; 441/76, 441/77, 79; 36/122, 123, 124, 125, 115, 36/116

See application file for complete search history.

(56) References Cited

U.S. PATENT DOCUMENTS

| | | | | |
|---|---|---|---|---|
| 579,695 | A * | 3/1897 | Carmina-Morreale | 441/77 |
| 2,260,057 | A * | 10/1941 | Rydberg | 280/603 |
| 2,410,702 | A | 11/1946 | Arsenault | 36/4.5 |
| 3,090,978 | A * | 5/1963 | Hanson | 441/70 |
| 3,484,958 | A * | 12/1969 | Novak et al. | 36/123 |
| 3,861,698 | A | 1/1975 | Greig | 280/11.13 |
| 4,334,369 | A | 6/1982 | Brunel | 36/124 |
| 4,674,764 | A * | 6/1987 | Miesen | 280/604 |
| 4,720,928 | A * | 1/1988 | Faber et al. | 36/122 |
| 5,553,403 | A | 9/1996 | McManus | 36/124 |
| 5,944,334 | A | 8/1999 | Zhao | 280/600 |
| 5,966,844 | A * | 10/1999 | Hellerman et al. | 36/122 |
| 6,367,173 | B1 * | 4/2002 | Lancon | 36/122 |
| 6,505,423 | B1 * | 1/2003 | Klebahn et al. | 36/124 |
| 6,955,236 | B1 * | 10/2005 | Roberts et al. | 180/182 |
| 2001/0038192 | A1 | 11/2001 | McManus et al. | 280/601 |
| 2002/0017771 | A1 | 2/2002 | McManus et al. | 280/600 |
| 2003/0052473 | A1 * | 3/2003 | Perkins et al. | 280/624 |

FOREIGN PATENT DOCUMENTS

| | | | | |
|---|---|---|---|---|
| DE | 38 11253 | | 10/1989 | |
| DE | 3811253 | A1 * | 10/1989 | |
| FR | 08810255 | * | 2/1990 | 280/28.14 |
| FR | 08818255 | * | 2/1990 | |
| WO | WO 9728860 | A1 * | 8/1997 | |

OTHER PUBLICATIONS

Yupi skishoes, www.yupiskishoes.com.
Play whistler.com.

* cited by examiner

*Primary Examiner*—Christopher P. Ellis
*Assistant Examiner*—John Walters
(74) *Attorney, Agent, or Firm*—Kunzler & Associates

(57) ABSTRACT

A device and method are disclosed for a configurable snowshoe and ski device. The device may include a base member having a bottom for traversing over snow, and a plurality of wings rotatably coupled to the member, the wings convertible between a skiing configuration in which the wings form a surface for gliding over snow and a snowshoe configuration in which the wings extend outward laterally. Also, the device may include a first locking device configured to maintain the plurality of wings in the snowshoe configuration, and a second locking device configured to maintain the plurality of wings in the skiing configuration. The method may include rotatating a plurality of wings coupled to a base member outward laterally to form a snowshoe configuration, and rotating the plurality of wings inward to form a skiing configuration in which the wings form a surface for gliding over snow.

19 Claims, 7 Drawing Sheets

CONFIGURABLE SNOWSHOE AND SKI DEVICE

CROSS-REFERENCES TO RELATED APPLICATIONS

This application claims benefit of U.S. patent application Ser. No. 10/211,504 entitled "INVENTION THAT PROVIDES SNOWSHOE AND SKI FUNCTIONS" and filed on Aug. 2, 2002 for Lane Ekberg et al., U.S. Provisional Patent Application No. 10/932,777 entitled "CONFIGURABLE SNOWSHOE AND SKI DEVICE" and filed on Sep. 2, 2003 for Lane Ekberg, and U.S. Provisional Patent Application No. 60/540,766 entitled "CONVERTIBLE SNOWSHOE AND SKI DEVICE" and filed on Jan. 30, 2004 for Lane Ekberg , which is incorporated herein by reference.

BACKGROUND OF THE INVENTION

1. Field of the Invention

This invention relates to winter sports equipment and more particularly relates to a configurable snowshoe and ski device.

2. Description of the Related Art

Snowshoeing is a popular winter sport that provides backcountry exploration, exercise, and entertainment. Likewise, downhill skiing and snowboarding are enjoyed for many of the same reasons. In a single day, backcountry enthusiasts typically snowshoe to their destination, and return on skis or snowboards. Unfortunately, the enthusiast must pack equipment for both snowshoeing and skiing or snowboarding. The added weight and hassle of packing up the necessary gear is an obvious disadvantage of this activity. However, many enthusiasts go through the hassle of packing extra gear in order to avoid the price of lift tickets, crowds at ski resorts, and to find untracked snow.

A solution to the added weight and expense of extra gear is to combine the utility of a snowshoe with that of a ski. Prior ski and snowshoe combinations have been formed with wings that are rotatable and substantially equivalent in length to the ski. A wing is attached to each side of the ski, and the wings rotate upward about a pair of hinges. When the wings are in the upward position the device functions as a ski, and conversely as a snowshoe when the wings are substantially parallel to the base of the ski. The device functions as intended, however the size and implementation of the wings cause contact with the leg of the user.

Not only do such wings limit the range of motion of the user, but the wings also accumulate snow on the device. Furthermore, snowshoeing is most effective when the ball of the user's foot is able to rotate through the plane of the snowshoe's top surface, thus allowing the toe of the foot to grip or dig into the surface of the snow. This is impossible with such a ski design with wings. Finally, it is advantageous for the pivot point of the foot to be located about one-third of the length of the snowshoe away from the front of snowshoe. Some snowshoes have this feature of foot placement and pivotability incorporated in their design as it requires less energy to walk or ascend hills. Also, the shorter protruding front section enables better mobility.

Another prior solution to the combination snowshoe/ski problem is a device which contains a short gliding surface functioning as a ski adjacent to a snowshoe surface. To convert from the ski surface to the snowshoe surface, one must remove the device, rotate the device 90° onto the edge, and reattach the device. Again, this device comes in contact with the legs of the user and limits the user's range of motion while in ski mode. Additionally, this type of snowshoe/ski does not allow the foot of the user to rotate through the plane of the snowshoe which aids in the traction or grip of the snow surface as seen in traditional snowshoes.

What is needed is a device that overcomes the added expense and weight of packing both snowshoes and skis or snowboards. Also, what is needed is a device that combines a snowshoe and ski while enabling a user's foot to rotate through the plane of the apparatus in order to facilitate walking and climbing. Additionally, a device that is easily converted, preferably without the requirement of removing the device.

SUMMARY OF THE INVENTION

The present invention has been developed in response to the present state of the art, and in particular, in response to the problems and needs in the art that have not yet been fully solved by currently available snowshoe/ski devices. Accordingly, the present invention has been developed to provide a configurable snowshoe and ski device that overcomes many or all of the above-discussed shortcomings in the art.

The device may include a base member having a bottom for traversing over snow, and a plurality of wings rotatably coupled to the member, the wings convertible between a skiing configuration in which the wings form a surface for gliding over snow and a snowshoe configuration in which the wings extend outward laterally. Additionally, the device may include a first locking device configured to maintain the plurality of wings in the snowshoe configuration, and a second locking device configured to maintain the plurality of wings in the skiing configuration.

In a further embodiment, each wing forms an outer edge for turning on snow or ice when the plurality of wings is in the skiing configuration, and the bottom forms a substantially continuous surface together with the plurality of wings when the plurality of wings is in the skiing configuration. The device may also include a binding device rotatably connected with the base member, the binding device configured to couple a user to the base member and comprising a toe section, and a heel section.

In one embodiment, the toe section is rotatably coupled with the base member and configured to rotate through the plane of the base member allowing the heel section to freely move in order to allow the user to walk. In order to facilitate skiing, the device may comprise a locking pin configured to fixedly couple the heel section with the base member in order to facilitate skiing over snow-covered terrain.

In another embodiment, the device includes a plurality of traction devices configured for gripping snow or ice when the plurality of wings is in the snowshoe configuration. Additionally, the base member may be molded substantially from a single material, such as, but not limited to a lightweight and rigid polymer. Furthermore, the device may comprise a torsion spring configured to rotate the plurality of wings through a range of between about 120° and 180°. The device may also include removably coupled front and rear portions.

A method of the present invention is also presented for configuring a device between a snowshoe and a ski configuration. The method in the disclosed embodiments substantially includes the steps necessary to carry out the functions presented above with respect to the operation of the described device. In one embodiment, the method includes rotatating a plurality of wings coupled to a member outward laterally to form a snowshoe configuration, and rotating the plurality of wings inward to form a skiing configuration in which the wings form a surface for gliding over snow.

The method may also include maintaining the plurality of wings in the snowshoe configuration, maintaining the plurality of wings in the skiing configuration, and turning on snow or ice when the plurality of wings is in the skiing configuration Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 1:
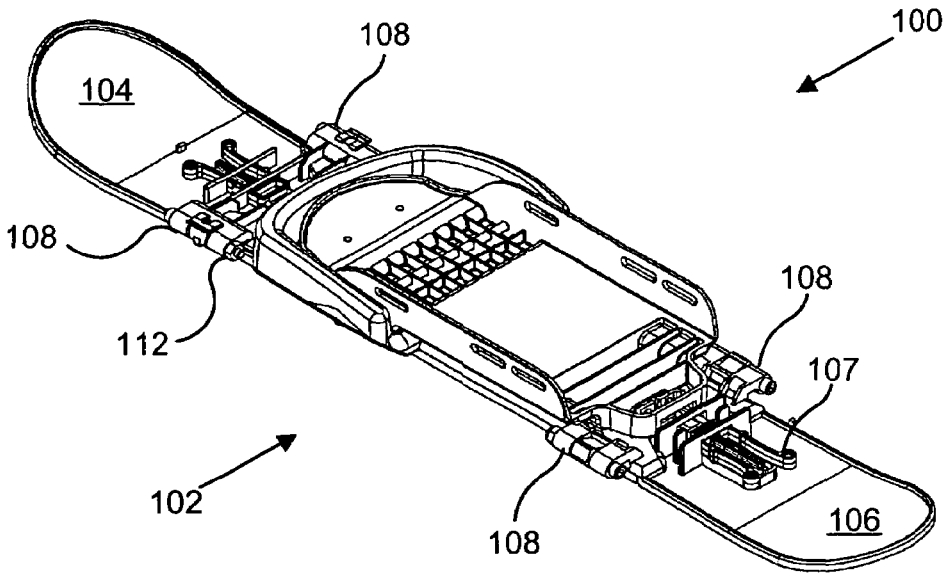
FIG. 1 is a perspective view diagram illustrating one embodiment of a configurable snowshoe and ski device in a ski configuration in accordance with the present invention.

FIG. 1 is a perspective view diagram illustrating one embodiment of a configurable snowshoe and ski device 100 in a ski configuration in accordance with the present invention. In one embodiment, the device 100 comprises a base member 102 having a front portion 104 and a rear portion 106. The front and rear portions 104, 106 may be removably coupled to the base member 102 using a locking device 107. In a further embodiment, the locking device 107 comprises a spring loaded, or tension mechanism having a plurality of shafts configured to engage a plurality of holes and secure the front and rear portions 104, 107 to the base member 102 (see FIGS. 5 and 9).

The device 100 may also include a plurality of hinges 108 configured to receive a plurality of wings 110 (see FIG. 2) and enable each wing 110 to rotate about the hinge 108. Additionally, a plurality of torsion spring pins 112 may couple the wing 110 to the hinge 108 and cause each wing 110 to extend outward laterally (see FIG. 2) and remain in a snowshoe configuration until manually rotated inward and locked in the skiing configuration with the locking device 107.

The device 100 may be formed of substantially one material. In one embodiment, the material may comprise a high-impact thermoset plastic such as, but not limited to, polyurethane. Alternatively, the device 100 may be formed of multiple materials, for example, the base member 102 may be formed of a lightweight aluminum while the plurality of wings 110 is formed of a plastic material.

Figure 2:
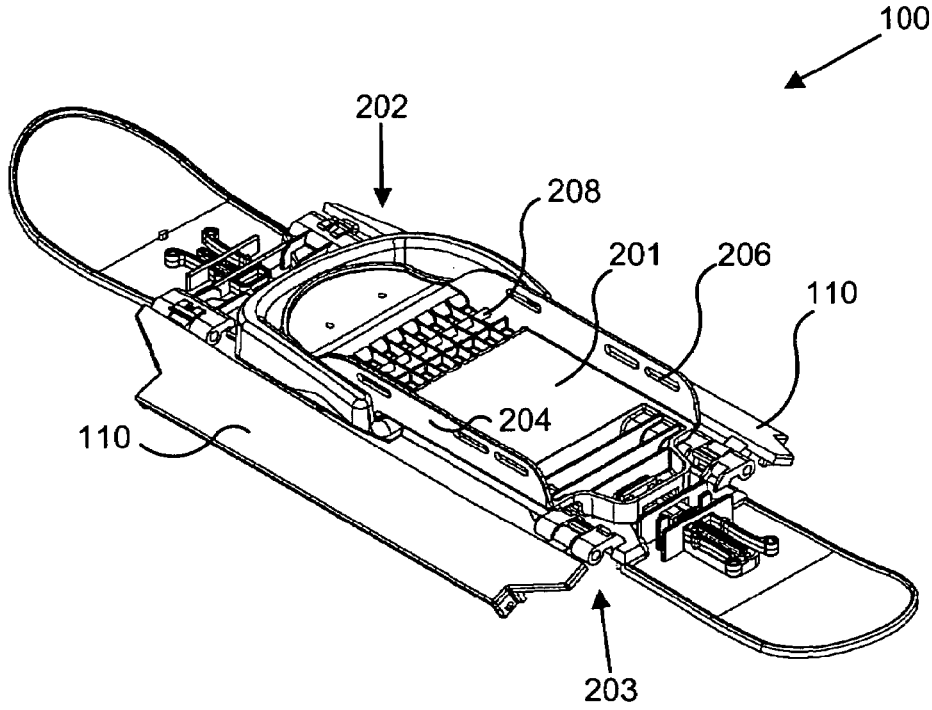
FIG. 2 is a perspective view diagram illustrating an alternative embodiment of the configurable snowshoe and ski device in a snowshoe configuration in accordance with the present invention.

FIG. 2 is a perspective view diagram illustrating an alternative embodiment of the configurable snowshoe and ski device 100 in a snowshoe configuration in accordance with the present invention. In one embodiment, the device comprises the wings 110 and a mounting plate 201 for receiving a binding device. The mounting plate includes a toe portion 202 and a heel portion 203. The mounting plate 201, in a further embodiment, is formed of substantially the same material as the base member 102. The mounting plate 201 may include side portions 204 extending upward and have slots 206 for securing the binding device.

The mounting plate 201, in one embodiment, is configured to pivot about a pivot point 208. The pivot point 208 may comprise an axle (not shown) configured to pass through the mounting plate 201 and secure the mounting plate 201 to the base member 102. The pivot point 208 also enables rotation of the mounting plate 201 such that toe portion 202 may pass through the plane of the base member 102 and the heel portion 203 may rise and fall as with the natural walking motion of a user.

Figure 3:
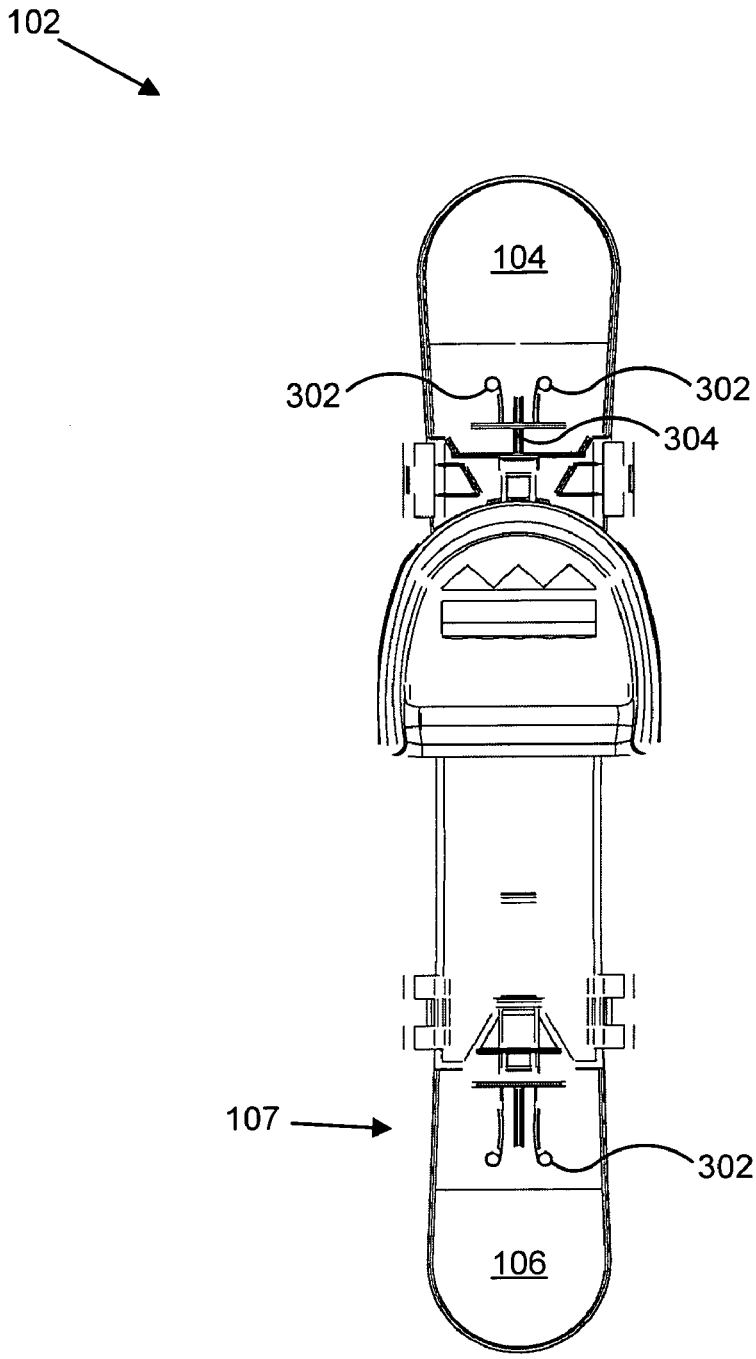
FIG. 3 is a top plan view illustrating one embodiment of the base member in accordance with the present invention.

FIG. 3 is a top plan view illustrating one embodiment of the base member 102 n accordance with the present invention. In one embodiment, the front and rear portions 104, 106 are coupled to the base member 102 as described above with reference to FIG. 1. The locking devices 107 may include quick-release tabs 302 and shafts 304. The quick-release tabs may be pressed together thereby releasing the locking device 107 from the base member 102. Such quick-release systems are well known to those skilled in the art and therefore, will not be given further discussion herein.

Figure 4:
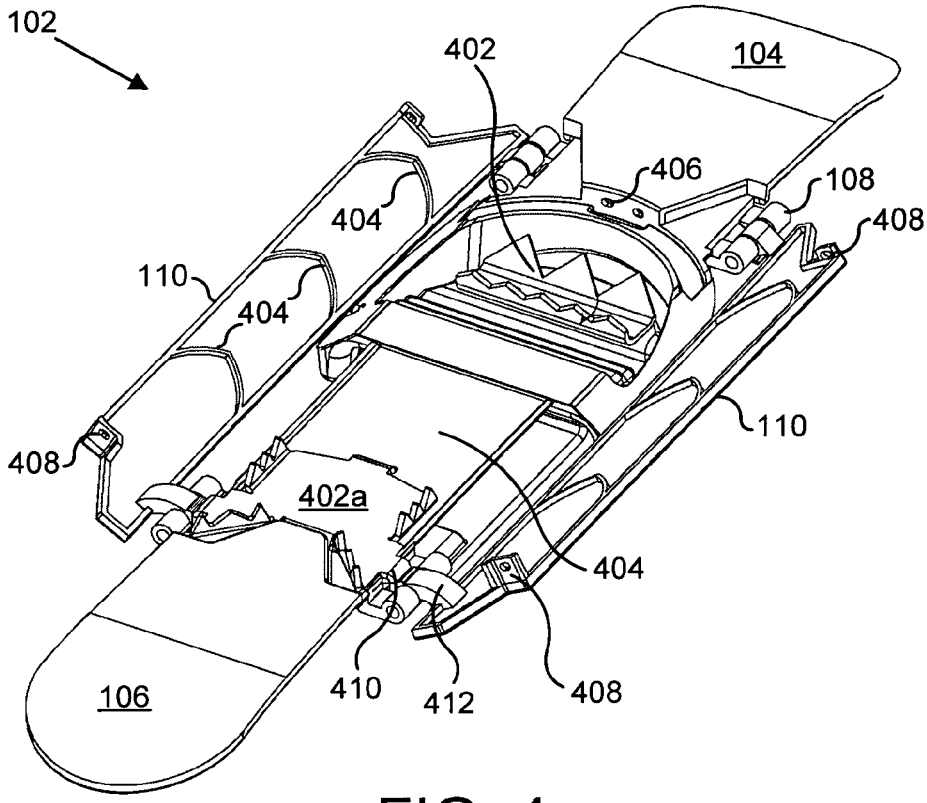
FIG. 4 is a bottom perspective view illustrating one embodiment of the base member in accordance with the present invention.

FIG. 4 is a bottom perspective view illustrating one embodiment of the base member 102 in the snowshoe configuration in accordance with the present invention. In one embodiment, the base member 102 comprises a plurality of traction devices 402. The traction devices 402 may be connected to a bottom surface 404 of the mounting plate 201. The traction devices 402 may be formed of substantially the same material as the base member 102, or alternatively of a metal-based material such as a lightweight titanium alloy, or the like. The traction devices 402 may be connected to the mounting plate 201 using a fastening device such a nut and bolt. In an alternative embodiment, the traction devices 402 and the mounting plate 201 are formed as a single unit.

In another embodiment, a removable traction device 402*a* may be implemented. The traction device 402*a* may include a tab 410 that extends perpendicularly from the traction device 402*a* and is configured to engage the surface of a wing hinge 412 such that the wing 110 is locked in the snowshoe configuration. The removable traction device 402*a* may have holes (not shown) configured to receive the locking device 107 and thereby be held in place by the locking device 107.

Bottom surfaces of the wings 110 may include a plurality of ridges 404 extending outward from the bottom surface of each wing 110. The plurality of ridges may be configured to increase the traction of the base member 102 while in the snowshoe configuration.

In a further embodiment, the base member 102 comprises a plurality of holes 406 for receiving the shaft of the locking device 107. Each wing 110 comprises a plurality of tabs 408, each tab 408 having a hole (not shown) that aligns with the hole 406 of the base member 102 when the wings 110 are rotated inward to form the ski configuration. With the hole 406 aligned with the hole of the tab 408, the shaft of the locking device 107 may engage both the base member 102 and the wing 110 in order to secure either the front or the rear portion 104, 106 to the base member and secure each wing 110 in the ski configuration.

Figure 5:
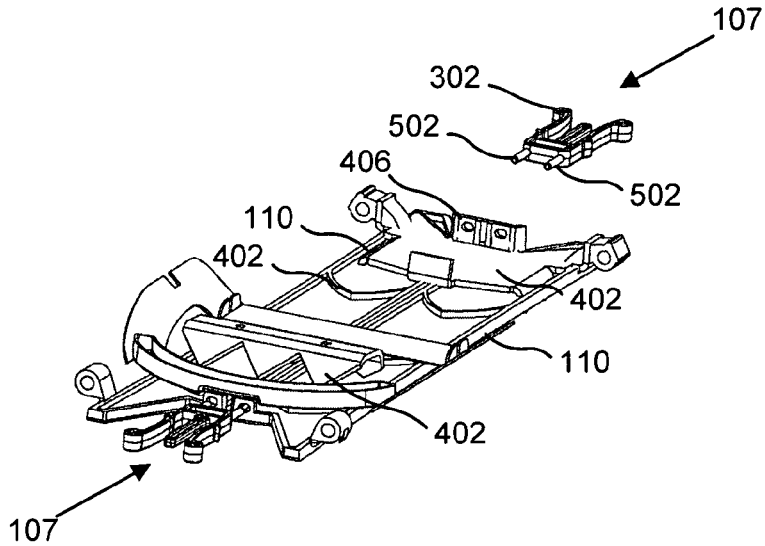
FIG. 5 is a bottom perspective view illustrating one embodiment of a plurality of wings in accordance with the present invention.

FIG. 5 is a bottom perspective view illustrating one embodiment of the plurality of wings 110 in the ski configuration in accordance with the present invention. In one embodiment, each locking device 107 comprises a plurality of shafts 502, each shaft 502 configured to engage the hole in one tab 408 of one wing 110. The inserted locking device 107 maintains the plurality of wings 110 in the ski configuration and prevents the traction devices from coming in contact with a surface, such as snow.

Figure 6:
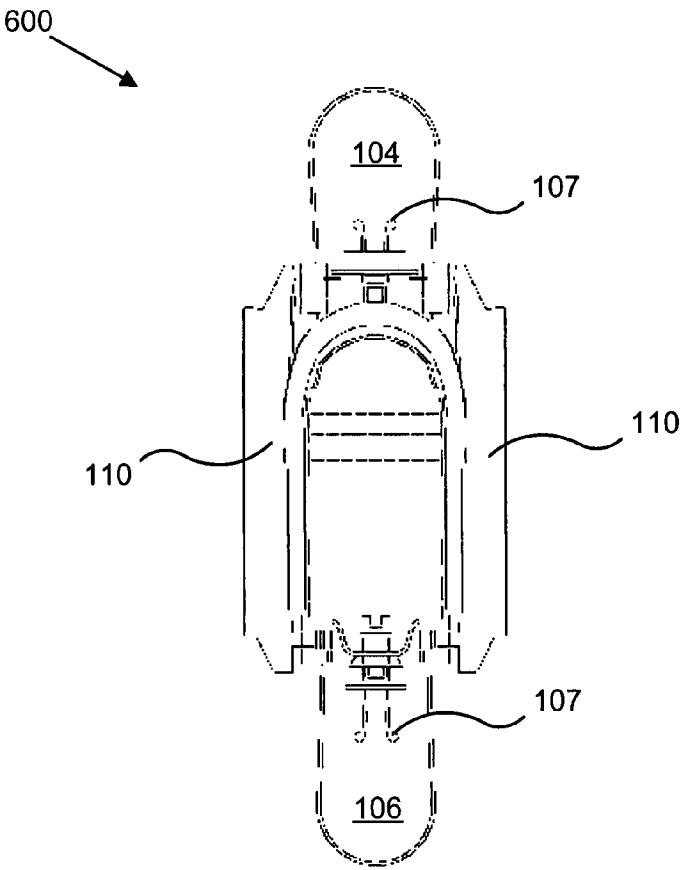
FIG. 6 is a top view diagram illustrating one embodiment of the snowshoe configuration in accordance with the present invention.

FIG. 6 is a top view diagram illustrating one embodiment of the snowshoe configuration in accordance with the present invention. In the depicted embodiment, the plurality of wings 110 extend laterally outward from the base member 102 to form the snowshoe configuration. The extension of the wings 110 effectively increases the bottom surface area of the device 100 and enables the user to traverse snow and ice covered terrain as with a traditional snowshoe. In a further embodiment, the front and/or rear portions may be removed while in snowshoe configuration 600 in order to facilitate traversal of snow and ice covered terrain.

Figure 7:
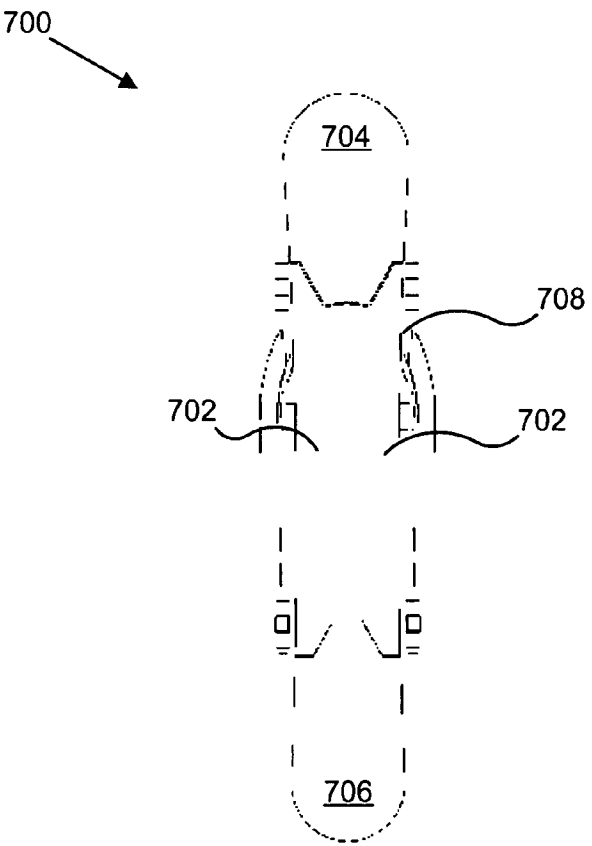
FIG. 7 is a bottom view diagram illustrating one embodiment of the ski configuration in accordance with the present invention.

FIG. 7 is a bottom view diagram illustrating one embodiment of the ski configuration 700 in accordance with the present invention. In one embodiment, the device 100 in ski configuration 700 includes bottom surfaces 702 of the wings and bottom surfaces 704, 706 of the front and rear portions. The bottom surfaces 702, 704, 706 in ski configuration together form a substantially continuous skiing surface with a low coefficient of friction for gliding over snow and ice covered terrain.

The bottom surfaces 702, 704, 706, may be waxed in a manner similar to traditional skis and snowboards. In a further embodiment, the device 100 in ski configuration 700 may include edges 708 having a generally concave shape for turning on ice or snow. The edges 708 may be formed of metal as with a ski or snowboard. The edges 708 may extend on each side of the device from the front portion 104 to the rear portion 106. Alternatively, the edges 708 may be formed only on the wing 110 portions of the bottom surface.

Figure 8:
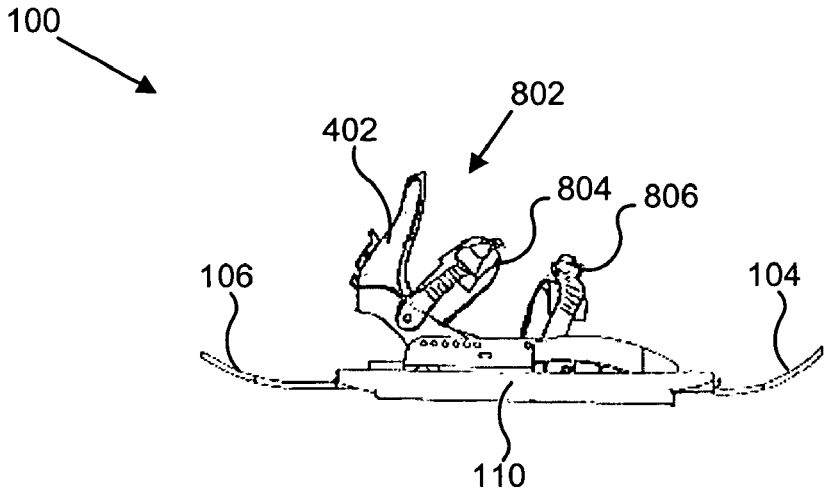
FIG. 8 is a side view diagram illustrating on embodiment of the device in the snowshoe configuration and having a binding device in accordance with the present invention.

FIG. 8 is a side view diagram illustrating on embodiment of the device in the snowshoe configuration and having a binding device 802 in accordance with the present invention. In one embodiment, the binding device 802 comprises an adjustable ankle strap 804 and an adjustable toe strap 806. Additionally, the binding device 802 may include a calf support assembly 808. The binding device 802 may comprise a standard snowboard binding system having ratchet straps for securing the foot of the user. Alternatively, the binding device 802 may comprise a traditional locking downhill or cross-country ski binding.

Figure 9:
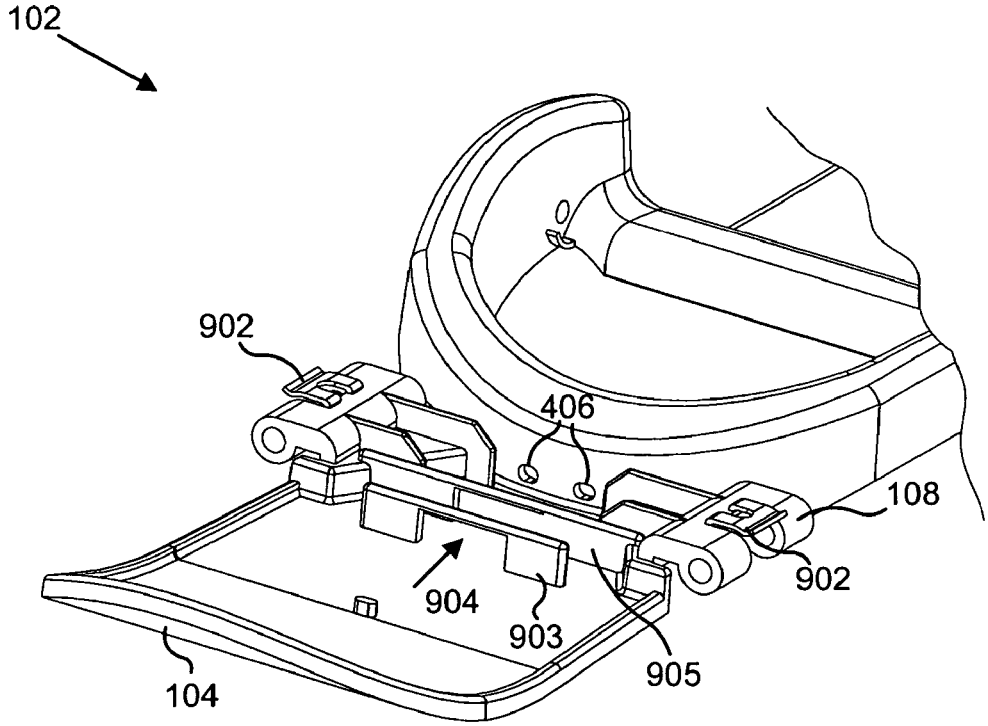
FIG. 9 is a front perspective view diagram illustrating one embodiment of a front portion of the device in accordance with the present invention.

FIG. 9 is a front perspective view diagram illustrating one embodiment of a front portion 104 of the device in accordance with the present invention. In one embodiment, the base member 102 comprises a plurality of second locking devices or wing locking tabs 902. The wing locking tabs 902 may be coupled to the hinges 108 and configured to snap into a slot (not shown) of the wing 110 when the wing 110 is rotated outward to the snowshoe configuration.

In a further embodiment, the front portion 104 includes a plate 903 extending upward from the front portion 104 and having an opening 904 for receiving the locking device 107. The base member 102 likewise may have a similarly sized plate 905 having an opening (not shown) and configured to engage a surface of the first plate 903.

The locking device 107 is configured to pass through the openings 904 in the plates 903, 905 and engage the holes 406 of the base member 102. As described above, the locking device may simultaneously engage the front portion 104, the base member 102, and the tabs 408 of the wings 110. The quick-release tabs 302 of the locking device 107 also are configured to pass through the opening 904 and engage the plate 905.

Similarly, the locking device 107 may couple the rear portion 106 to the base member 102 while engaging and securing both the wings 110 and the heel 203 of the mounting plate. Securing the heel portion 203 of the mounting plate 202 enables the user to ski in a manner similar to a downhill skier.

Figure 10:
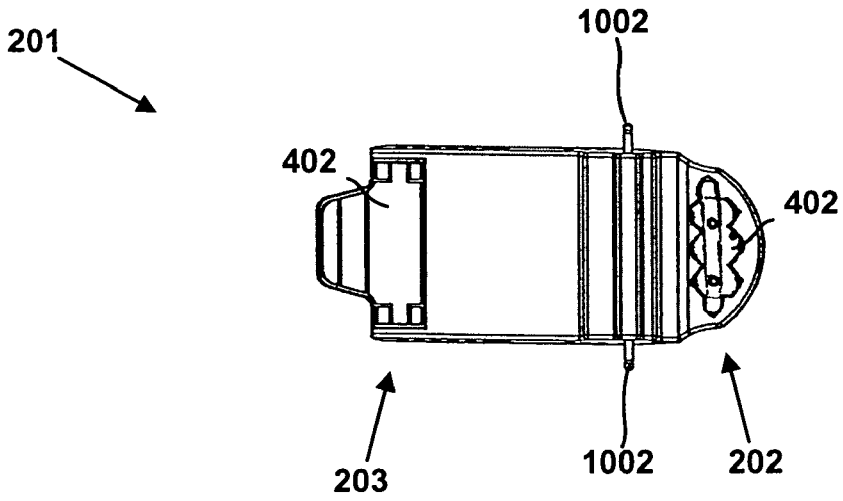
FIG. 10 is a top view diagram illustrating one embodiment of a mounting plate in accordance with the present invention.

FIG. 10 is a top view diagram illustrating one embodiment of the mounting plate 202 in accordance with the present invention. In one embodiment, the mounting plate 202 is formed to roughly the size of a boot. The mounting plate 202 may be formed to different sized in order to accommodate different size users. The axle 1002 (as described above with reference to FIG. 2) is configured to pass through the mounting plate 202 and secure the mounting plate 202 to the base member 102 while allowing the mounting plate 202 to pivot about the axle 1002.

Figure 11:
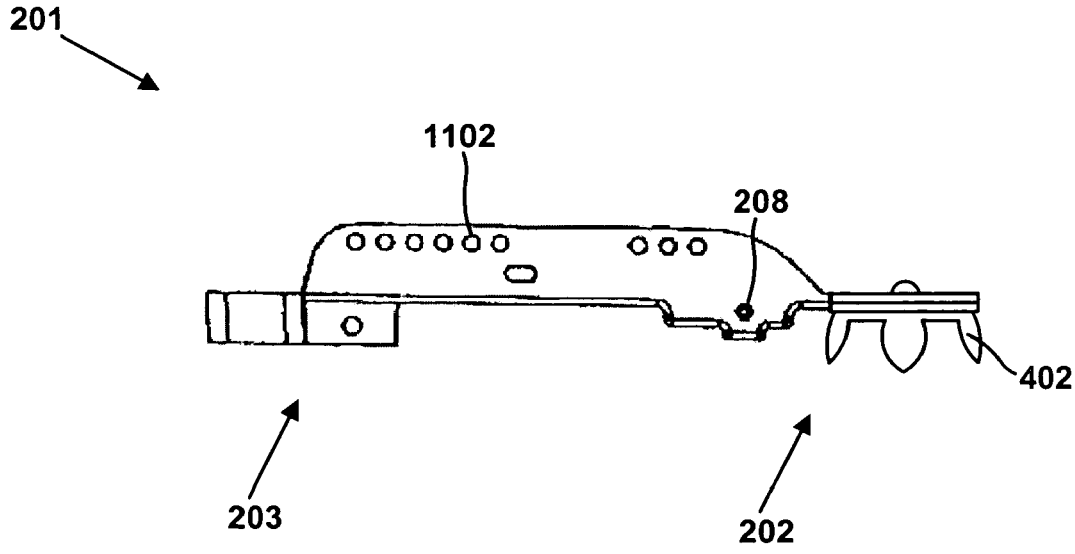
FIG. 11 is side view diagram of the mounting plate in accordance with the present invention.

FIG. 11 is side view diagram of the mounting plate 202 in accordance with the present invention. In a further embodiment, the mounting plate 202 may comprise a plurality of holes 1102 for securing the binding device 802. The plurality of holes 802 enables the user to position the binding device 802 to suit his or her boot size. As depicted, the pivot point 208 is located generally beneath the ball of the foot (not shown) of the user. However, the pivot point 208 may be adjusted to suit the comfort of the user.

The schematic flow chart diagram that follows is generally set forth as a logical flow chart diagram. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting period of unspecified duration between enumerated steps of the depicted method. Additionally, the order in which a particular method occurs may or may not strictly adhere to the order of the corresponding steps shown.

Figure 12:
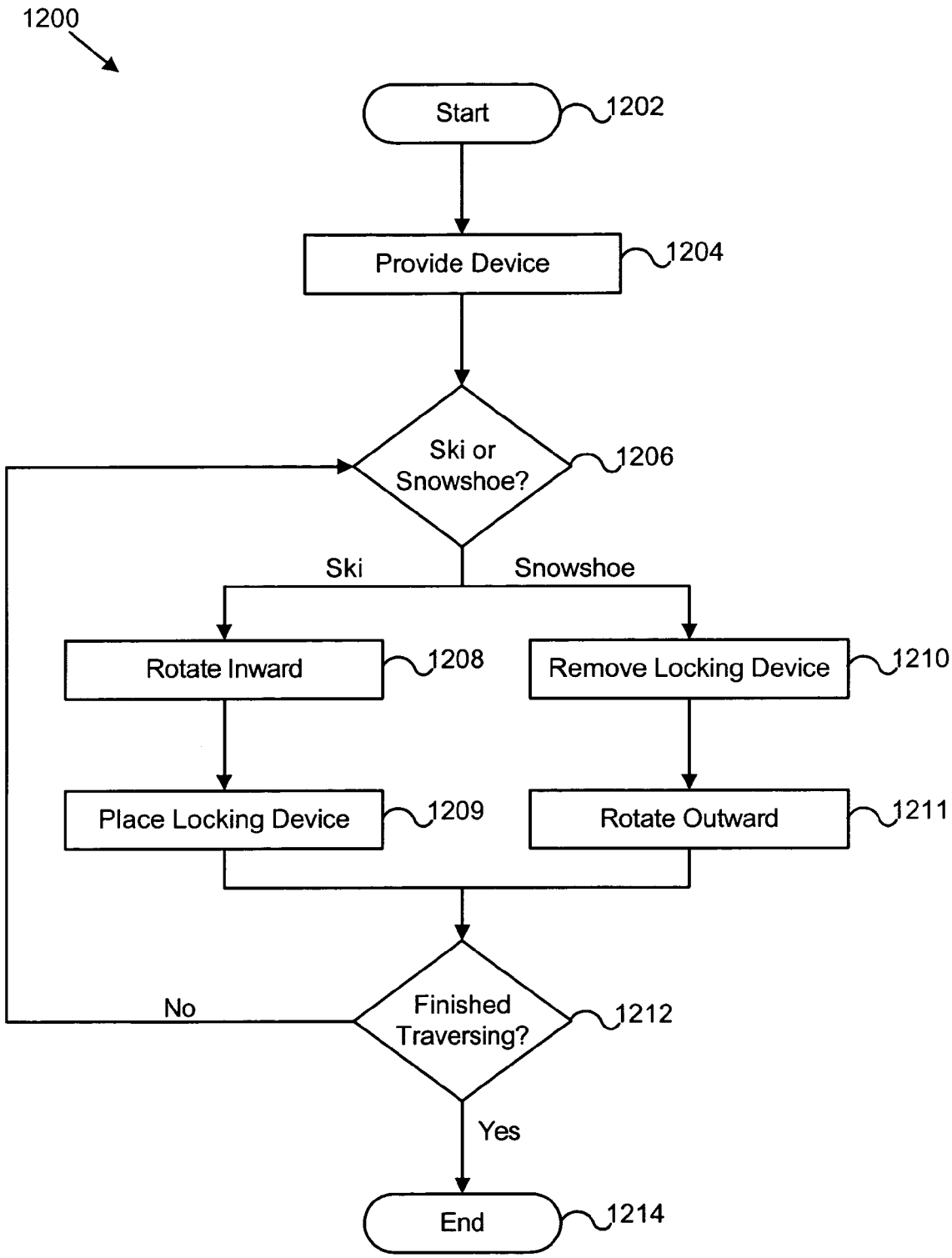
FIG. 12 is a schematic flow chart diagram illustrating one embodiment of a method for configuring the snowshoe ski device in accordance with the present invention.

FIG. 12 is a schematic flow chart diagram illustrating one embodiment of a method 1200 for configuring the snowshoe ski device in accordance with the present invention. The method 1200 starts 1202 and a snowshoe ski device 100 is provided. In one embodiment, providing 1202 the snowshoe ski device 100 comprises injection molding the device 100 from substantially the same material. The material may be a high-impact plastic. Alternatively, providing 1202 the device 100 may comprise forming the device from composite materials such as metal-based composites.

The user then decides 1206 whether to use the device 100 in ski configuration or snowshoe configuration. If the user chooses 1206 ski configuration, the wings are rotated 1208 inwards to form the substantially continuous skiing surface and places 1209 the locking devices 107 into the holes 406.

Alternatively, if the user chooses 1206 the snowshoe configuration, the user removes 1210 the locking devices 107 by compressing the quick-release tabs 302 and releasing the wings 110. The torsion spring pins 112 cause the wings 110 to rotate outward 1211 and form the snowshoe configuration. The user may then decide whether to leave the front and rear portions 104, 106 attached to the base member 102. If the user is finished 1212 traversing snow and ice covered terrain, the method 1200 ends.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A device configurable between a snowshoe configuration and a skiing configuration, the device comprising:

a base member having a bottom for traversing over snow;

a plurality of wings dynamically coupled to the base member, the wings convertible between a skiing configuration in which the wings form a surface for gliding over snow and a snowshoe configuration in which the wings extend outward laterally;

wherein the plurality of wings cooperate with the bottom of the base member to form a substantially continuous skiing surface;

a first locking device configured to maintain the plurality of wings securely in the snowshoe configuration; and a second locking device configured to maintain the plurality of wings securely in the skiing configuration.

2. The device of claim 1, wherein each wing forms an outer edge for turning on snow or ice when the plurality of wings is in the skiing configuration.

3. The device of claim 1, further comprising a binding device rotatably connected with the base member, the binding device configured to couple a user to the base member and comprising a toe section, and a heel section.

4. The device of claim 1, further comprising an axle configured to rotatably couple the binding device with the base member and enable the binding device to rotate through the plane of the base member allowing the toe and heel section to freely move in order to allow the user to walk.

5. The device of claim 4, wherein the axle releasably couples the binding device to the base member.

6. The device of claim 1, further comprising a plurality of traction devices configured for gripping snow or ice when the plurality of wings is in the snowshoe configuration.

7. The device of claim 6, wherein at least one traction device is configured to couple with the toe section and rotate through the plane of the base member.

8. The device of claim 1, wherein the binding device further comprises a locking device configured to fixedly couple the heel section with the base member in order to facilitate skiing over snow-covered terrain.

9. The device of claim 1, wherein the base member is molded substantially from a single material.

10. The device of claim 9, wherein the material comprises a lightweight and rigid polymer.

11. The device of claim 1, further comprising a torsion spring configured to rotate the plurality of wings into the snowshoe configuration.

12. The device of claim 11, wherein the torsion spring is configured to rotate the plurality of wings through a range of between about 120° and 180° into the snowshoe configuration.

13. The device of claim 12, wherein the torsion spring is configured to rotate the plurality of wings through a range of about 150° into the snowshoe configuration.

14. The device of claim 1, further comprising removably coupled front and rear portions.

15. A device configurable in a snowshoe configuration and a skiing configuration, the device comprising:

a base member having a bottom for traversing over snow;

a plurality of wings dynamically coupled to the base member, the wings convertible between a skiing configuration in which the wings form a surface for gliding over snow and a snowshoe configuration in which the wings extend outward laterally;

wherein the plurality of wings cooperate with the bottom of the base member to form a substantially continuous skiing surface;

a first locking device configured to maintain the plurality of wings securely in the snowshoe configuration;

a second locking device configured to maintain the plurality of wings securely in the skiing configuration;

a binding device rotatably connected with the base member, the binding device configured to couple a user to the base member and comprising a toe section, and a heel section; and a plurality of traction devices configured for gripping snow or ice when the plurality of wings is in the snowshoe configuration.

16. The device of claim 15, wherein each wing forms an outer edge for turning on snow or ice when the plurality of wings is in the skiing configuration.

17. The device of claim 15, further comprising a torsion spring configured to rotate the plurality of wings into the snowshoe configuration.

18. The device of claim 15, further comprising removably coupled front and rear portions.

19. A method for configuring a device in a snowshoe configuration and a skiing configuration, the device comprising:

transitioning a plurality of wings coupled to a base member outward laterally to form a snowshoe configuration, and transitioning the plurality of wings inward to form a skiing configuration in which the wings form a surface for gliding over snow, with the plurality of wings cooperating with the bottom of the base member to form a substantially continuous skiing surface;

maintaining the plurality of wings securely in the snowshoe configuration; and maintaining the plurality of wings securely in the skiing configuration.

* * * * *